United States Patent [19]

Waterkamp

[11] 4,255,662

[45] Mar. 10, 1981

[54] X-RAY DIAGNOSTIC APPARATUS HAVING OPERATING KEYS FOR THE ORGANWISE PROGRAMMED SETTING OF EXPOSURE DATA

[75] Inventor: Amandus Waterkamp, Bonn, Fed. Rep. of Germany

[73] Assignee: Siemens Aktiengesellschaft, Berlin & Munich, Fed. Rep. of Germany

[21] Appl. No.: 968,219

[22] Filed: Dec. 11, 1978

[30] Foreign Application Priority Data

Dec. 14, 1977 [DE] Fed. Rep. of Germany ..... 2755736

[51] Int. Cl.[3] ..... H05G 1/30

[52] U.S. Cl. ..... 250/416 R; 250/322

[58] Field of Search ..... 250/416, 402, 322, 408, 250/409, 320

[56] References Cited

U.S. PATENT DOCUMENTS

| | | | |
|---|---|---|---|
| 3,916,192 | 10/1975 | Schmitmann et al. | 250/322 |
| 4,137,571 | 1/1979 | Pfeifer | 250/320 |

*Primary Examiner*—Alfred E. Smith
*Assistant Examiner*—Thomas P. O'Hare
*Attorney, Agent, or Firm*—Hill, Van Santen, Steadman, Chiara & Simpson

[57] ABSTRACT

In an illustrative embodiment, body zone selector keys are associated with a visual representation of the human body. When a body zone key is actuated, the available exposure programs for specific organs or body portions in the selected body zone are displayed on respective indicator panels having respective adjacent operating keys. For the case of seven zone keys and seven operating keys, an electronic fixed value store (e.g. a PROM) may contain seven sets of storage locations, each set containing data for controlling the alphanumeric displays at the seven indicator panels to indicate available exposure programs related to one body zone. For example, there may be twelve matrices formed of LEDs in each indicator panel for display of twelve alphanumeric characters to designate the organs or body portions indicative of the seven different exposure programs currently available for selection.

5 Claims, 3 Drawing Figures

X-RAY DIAGNOSTIC APPARATUS HAVING OPERATING KEYS FOR THE ORGANWISE PROGRAMMED SETTING OF EXPOSURE DATA

BACKGROUND OF THE INVENTION

The invention relates to an x-ray diagnostic apparatus having operating keys for the organwise programmed setting of the exposure data via setting means and having respectively one indicator field assigned to each operating key for the respective body portions or body organs, having an indicator board which is common to all operating keys and also having means comprising a selective switching device for selecting one body zone recognizable from a specific number of body zones represented on the indicator board, the selective switching device being operatively constructed so as to visually associate selection of a body zone thereby with the representation of such body zone on the indicator board, the contacts of the selective switching device and the contacts of the operating keys controlling the setting means for the exposure data, a given set of exposure data relating to a set of specific body portions or organs becoming available when a specific body zone is selected, and in which sets of displays can be selectively presented at the indicator fields of the operating keys under the control of the selective switching device, each set of displays being assigned to the set of the body portions or organs of one of the body zones.

An x-ray diagnostic apparatus of this type permits selection of a great number of exposure data combinations by means of a relatively small number of operating keys. If, for example—as this is the case in the sample embodiment according to U.S. Pat. No. 3,916,192—seven body zones and seven operating keys are provided, forty-nine different exposure programs can be selected by means of the seven operating keys.

In the subject of the sample embodiment of U.S. Pat. No. 3,916,192, the indicator means, assigned to the operating keys, are formed by rollers which are turned by the selective switching device and are labeled according to the exposure programs possible. Thus, the indicator means are of a purely mechanical type and are connected to the selective switching device via a mechanical coupling, for example, a cable line. For such mechanical indicator means it is disadvantageous that they require relatively large space and are subject to malfunctions.

SUMMARY OF THE INVENTION

The invention has the underlying objective of improving an x-ray diagnostic apparatus of the initially mentioned type in regard to the construction of the indicator means, to decrease, in particular, the mechanical outlay for the indicator means.

This objective is inventively resolved in that an electronic fixed value store is present for all exposure data programs, said store possessing a specific number of store locations for representing each of the respective exposure data programs; such specific number depending upon the number of the alphanumeric symbols needed to display the program identification; said store being controlled by the selective switching device such that it respectively supplies a set of signals at its output for characterizing the set exposure data programs which correspond to the respectively selected body zone, and that the indicator means are formed by an electronic luminous display for providing the alphanumeric reproduction, said luminous display being actuated by the output signal of the electronic fixed value store. In the inventive x-ray diagnostic apparatus, the display of the set of body portions and thus of the set of exposure programs, corresponding with the selected body zone and respectively assigned to one of the operating keys, proceeds in a purely electronic manner. Mechanical connection means between the selective switching device and the indicator means are not required. The design of the arrangement necessary for the display can result from conventional components. The fixed value store and the luminous display, in particular, can consist of conventional modules.

An expedient embodiment of the invention is one wherein the selective switching device is formed by keys which are arranged in the respective assigned body zones of a human body visually represented on the display board. In this embodiment, the operator is directly oriented with reference to the human body, as represented on the indicator board, when the selective switching device is operated.

The invention is subsequently more precisely explained with the aid of the sample embodiment illustrated in the accompanying sheet of drawings; and other objects, features and advantages will be apparent from this detailed disclosure and from the appended claims.

DETAILED DESCRIPTION

Figure 1:
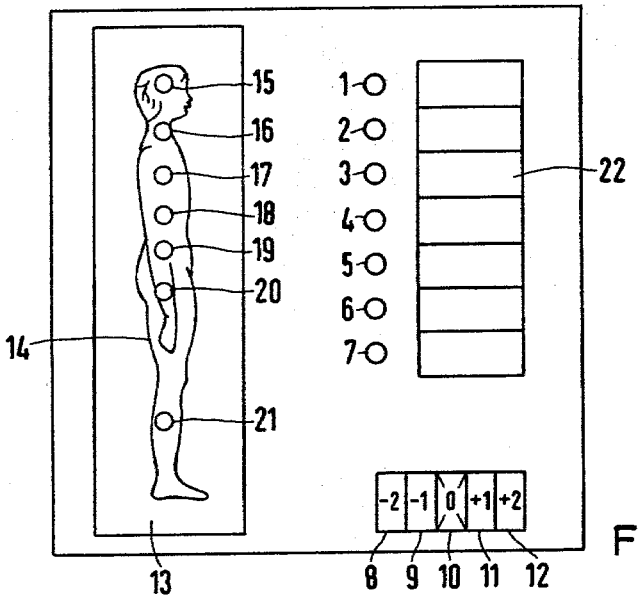
FIG. 1 shows a schematic illustration of the operating arrangement of an x-ray diagnostic apparatus according to the invention.

FIG. 1 illustrates seven operating keys 1 through 7 for the selection of the exposure programs. When one of the operating keys 1 through 7 is pressed, the setpoint values for the x-ray tube voltage and the mAs-product are, in particular, selected automatically. An adjustment of the preprogrammed data to the patient's body size is possible by five keys 8 through 12. Key 10 is depressed for a patient of average size, and the exposure program is thereby not altered. When one of the keys 8 or 9 is depressed, a reduction of the selected exposure values results for the adjustment to a relatively thin patient, and when one of the keys 11 or 12 is depressed, an increase of the exposure values selected results for the adjustment to a relatively obese patient.

In addition to the operating keys 1 through 7, an indicator board 13 is provided having a visual representation of the human body 14 recorded thereon. Seven selective keys 15 through 21 are provided for selecting a respective predetermined body zone of the human body as represented at 14.

For the setting of the exposure data for a specific body organ to be x-rayed, i.e. for the selection of a specific exposure program, one of the keys 15 through 21 is firstly to be pressed. During the pressing of one of these keys, a set of specific body organs of the selected body zone are assigned to the operating keys 1 through 7, and one of the corresponding set of exposure programs can then be selected by activating one of the keys 1 through 7. In the sample embodiment illustrated, $7\times7=49$ exposure programs are possible.

During the pressing of one of the keys 15 through 21, body organs of the selected body zone, assigned to the operating keys 1 through 7 are brought into display in a luminous display 22.

For the invention it is without importance what type of keys 1 through 7 and 15 through 21 are utilized. In the framework of the invention not only pressure keys but also proximity sensors can be utilized. The contacts of keys 1 through 7 and 15 through 21, disclosed in the main patent claim thus need not be of a mechanical type, but can also be electronic when sensors are utilized.

Figure 2:
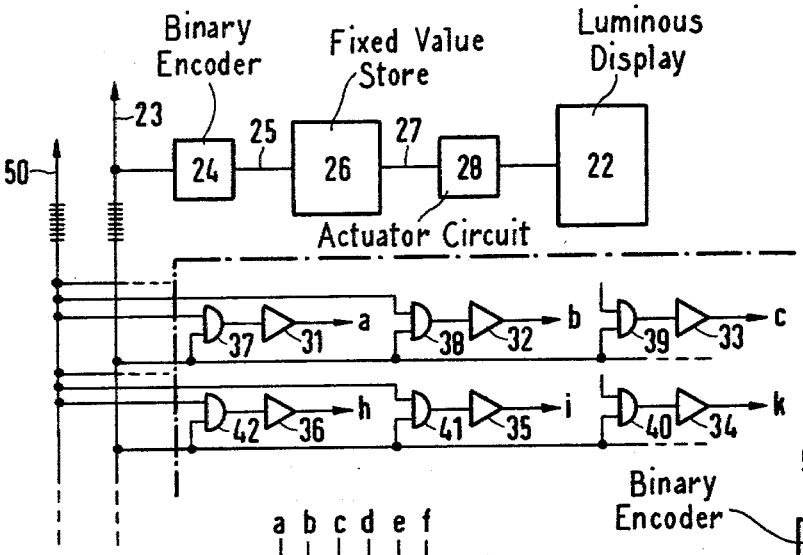
FIG. 2 shows a circuit diagram of the x-ray diagnostic apparatus according to FIG. 1.
Figure 2:
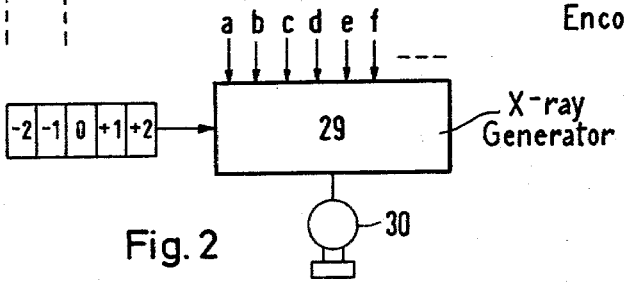

FIG. 2 represents by a line 23 a group of seven individual conductors, which are respectively assigned to the seven keys 15 through 21. In correspondence with the respectively activated key of keys 15 through 21, one of the seven individual conductors of line 23 conveys an input signal to a binary coder 24 which transforms the input signal into a binary signal at its output 25. This binary signal is conveyed to a fixed value store (PROM) 26 exhibiting a number of store locations for controlling display of an indication of each exposure program. This number of store locations is determined by the number of alphanumeric characters to be reproduced for indicating the particular exposure program. The store locations, respectively corresponding with each set of seven programs, are selected by the output signal of the binary coder 24. These selected store locations correspond with the set of seven exposure programs respectively assigned to the activated key 15 through 21. The indications of each of the body organs corresponding with these seven exposure programs, are displayed on the luminous display 22 opposite the respective operating keys 1 through 7 in response to corresponding signals at the output 27 of the fixed value store 26.

To this end, each panel of the luminous display 22, FIG. 1, possesses a line of luminous matrices consisting of luminescent diodes for generating a line of alphanumeric characters for each of the operating keys 1 through 7. For example, twelve luminous matrices can be provided in each line so that for each of the operating keys 1 through7 twelve different alphanumeric characters can be displayed. The luminous display 22 is actuated via an actuator (decoder and driver) circuit 28 for effecting the switching-on of the luminescent diodes in the luminous display 22, corresponding with the output signal configuration of the fixed value store 26.

For the setting of the exposure programs in an x-ray generator 29, which feeds an x-ray tube 30, the x-ray generator 29 has forty-nine inputs a, b, etc. Respectively one of the exposure programs, programmed in the x-ray generator 29, can be selected by means of a signal at one of these forty-nine inputs a, etc. The inputs a, etc. are thereby connected to the outputs of forty-nine amplifiers, of which—for simplicity's sake—only six amplifiers 31 through 36 are illustrated in FIG. 2. Each of these amplifiers is connected at the output of an AND-gate, of which also only six AND-gates 37 through 42 are illustrated in FIG. 2, also. The AND-gates with the amplifiers form a matrix consisting of seven lines and seven columns so that in total forty-nine AND-gates and forty-nine amplifiers are present.

If, for example, the exposure program corresponding with the input c of the x-ray generator 29 is to be selected, the key 15, for example, is firstly activated, the key 15 being one of keys 15 through 21 which correspond with the body zones as indicated in FIG. 1. Thereby a logical one signal is conveyed to the lower inputs of all the AND-gates of the first line, thus to the seven AND-gates such as 37 through 39 via the active one of the seven conductors of line 23, i.e. said ANd-gates are prepared (enabled). If subsequently the corresponding operating key 3 is actuated, the second (upper) input of the AND-gate 39 is occupied with a logical one signal via the active conductor of the seven individual conductors represented by line 50, so that a signal only appears at output c which sets the corresponding exposure program in the x-ray generator 29. A correction of this exposure program is possible via keys 8 through 12.

Figure 3:
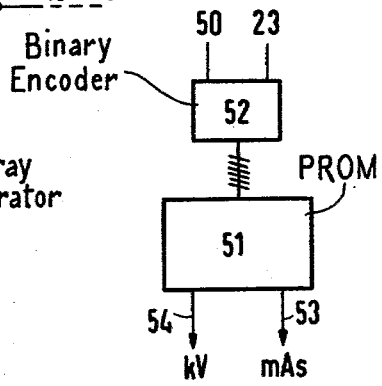
FIG. 3 shows a circuit variant of the x-ray diagnostic apparatus according to FIG. 1.

A circuit according to FIG. 3 can also be utilized in the framework of the invention in place of the matrix-like designed program selection circuit of FIG. 2 having AND-gates 37, etc. FIG. 3 illustrates a programmable read only memory (PROM) 51 which is actuated at its input by means of a binary signal which is supplied via six lines in parallel. This binary signal is supplied by a binary coder 52 to which the groups of conductors represented by lines 50 and 23 are connected. Thus, the binary signal at the input of PROM 51 corresponds with the exposure program respectively set with the aid of keys 15 through 21 and keys 1 through 7. All forty-nine exposure data programs are stored in PROM 51 so that the respectively set exposure data program is selected by the input signal. A binary signal is thereby connected at output 53 which characterizes the selected mAs-product, and a signal is connected to output 54 which characterizes the selected x-ray tube voltage. These binary signals effect the setting means for the mAs-product and the x-ray tube voltage.

By way of example, the binary encoder 24 may supply a binary code signal via three conductors to address the fixed value store. Each of seven binary code values which may be supplied via the conductors of line 25 may activate seven storage locations of fixed value store 26 having respective groups of binary coded words programmed therein. Each stored binary coded word may have a number of bits sufficient to uniquely identify any of the alphanumeric characters to be displayed. Where there are twelve luminous matrices per line of indicator 22, FIG. 1, the fixed value store 26 may have forty-nine storage locations each of which accommodates a group of twelve binary coded words. The actuator circuit 28 would include a decoder matrix or the like for converting each received binary coded word into the represented visual character at the assigned luminous matrix. For example, if button 15, FIG. 1, is actuated, this may result in the display of the names of seven body parts or organs of the head region on the seven panels of indicator 22. Similarly for the selection of any of the other body zones, the fixed value store 26 may control the display of a list of seven body parts or organs of the selected zone at indicator 22.

It will be apparent that many modifications and variations may be effected without departing from the scope of the novel concepts and teachings of the present invention.

I claim as my invention:

1. An x-ray diagnostic apparatus having operating keys for the organwise programmed setting of the exposure data, having an indicator field respectively assigned to each operating key for indicating respective body portions or body organs, and having an indicator board associated with the operating keys and including a representation of the body zones of a human body, and also means comprising a selective switching device for selecting a respective one of a specific number of body zones and for assigning a set of body portions or body organs for indication on the indicator fields according to the selected body zone, the selective switching device and the operating keys cooperating to determine the exposure data in conformity with the selected specific body part or body organ of the set corresponding to the selected specific body zone, and indicator means controlled by the selective switching device for producing at the indicator fields assigned to the respective operating keys a set of displays representing the respective body parts or body organs of the set corresponding to the selected body zone, characterized in that an electronic fixed value store (26) is present for controlling the indicator means (22), said store having a specific number of store locations corresponding to each setting of the selective switching device (15 through 21), said fixed value store being responsive to the setting of the selective switching device (15 through 21) such that said store respectively supplies a respective output signal which characterizes the respective set of displays representing body portions or body organs which correspond with the respectively selected body zone, and the indicator means (22) comprising an electronic luminous display for alphanumeric character reproduction, said luminous display being controlled by the output signal of the electronic fixed value store (26) to provide a set of alphanumeric displays at the indicator fields in accordance with the selected body zone.

2. An x-ray diagnostic apparatus according to claim 1, characterized in that setting means comprising a programmable read only memory (51) is operable for establishing the exposure data, said programmable read only memory being jointly responsive to the setting of the operating keys (1 through 7) and the selective switching device (15 through 21).

3. An x-ray diagnostic apparatus according to claim 1, characterized in that the selective switching device (15 through 21) is formed by keys which are arranged in the body zones as represented on the indicator board (13).

4. An x-ray diagnostic apparatus according to claim 1, characterized in that setting means comprising a programmable read only memory (51) is operable for establishing a number of exposure data programs corresponding to the number of combinations of settings of the operating keys (1 through 7) and the selective switching device (15 through 21), said setting means having means responsive to the settings of the operating keys to produce a binary output signal for representing a desired exposure data program, and the programmable read only memory being responsive to the binary output signal to supply exposure setting signals in accordance therewith.

5. An x-ray diagnostic apparatus according to claim 4 characterized in that the selective switching device (15 through 21) is formed by keys which are arranged in the body zones as represented on the indicator board (13).

* * * * *